US010736371B2

(12) United States Patent
Lee

(10) Patent No.: US 10,736,371 B2
(45) Date of Patent: Aug. 11, 2020

(54) MECHANICAL-WAVES ATTENUATING PROTECTIVE HEADGEAR

(71) Applicant: Choon Kee Lee, Denver, CO (US)

(72) Inventor: Choon Kee Lee, Denver, CO (US)

( * ) Notice: Subject to any disclaimer, the term of this patent is extended or adjusted under 35 U.S.C. 154(b) by 25 days.

(21) Appl. No.: 15/283,375

(22) Filed: Oct. 1, 2016

(65) Prior Publication Data

US 2018/0092421 A1 Apr. 5, 2018

(51) Int. Cl.
*A42B 3/06* (2006.01)
*A42B 3/12* (2006.01)
*A42B 3/28* (2006.01)

(52) U.S. Cl.
CPC ..... *A42B 3/063* (2013.01); *A42B 3/125* (2013.01); *A42B 3/283* (2013.01)

(58) Field of Classification Search
CPC ..... A42B 3/063; A42B 3/125; A42B 3/283; A42B 3/281
See application file for complete search history.

(56) References Cited

U.S. PATENT DOCUMENTS 4,213,202 A 7/1980 Larry
4,375,108 A 3/1983 Gooding
4,484,364 A 11/1984 Mitchell et al.
4,564,959 A 1/1986 Zahn
4,566,137 A 1/1986 Gooding
4,985,931 A 1/1991 Wingo, Jr.
5,517,698 A 5/1996 Nault et al.
5,940,889 A * 8/1999 Shirai ..... A42B 3/063 2/411
6,055,675 A 5/2000 Egger et al.
6,070,905 A 6/2000 Renault
6,105,176 A 8/2000 Egger
6,122,785 A 9/2000 Bondie et al.
6,317,896 B1 11/2001 Timms et al.
6,446,270 B1 9/2002 Durr
6,658,671 B1 12/2003 Von Holst et al.
6,839,910 B2 1/2005 Morrow et al.
6,931,671 B2 8/2005 Skiba
7,802,320 B2 9/2010 Morgan
7,832,023 B2 11/2010 Crisco
7,904,971 B2 3/2011 Doria et al.
8,566,968 B2 10/2013 Marzec et al.
8,615,817 B2 12/2013 Phillips
8,640,267 B1 * 2/2014 Cohen ..... A42B 3/063 2/411
8,683,617 B2 4/2014 Chilson et al.
8,756,719 B2 6/2014 Veazie
8,904,584 B2 12/2014 Sugano et al.
8,955,169 B2 2/2015 Weber et al.
8,973,171 B2 3/2015 Cleva
9,131,743 B2 9/2015 Marzec et al.
9,220,311 B1 12/2015 Baldi
9,332,800 B2 5/2016 Brown
9,408,423 B2 8/2016 Guerra
9,414,632 B1 * 8/2016 Dougherty ..... A42B 3/069
10,219,574 B2 * 3/2019 Lee ..... A42B 3/122

(Continued)

*Primary Examiner* — Katharine Gracz
*Assistant Examiner* — Brieanna Szafran

(57) ABSTRACT

The present invention provides a protective headgear having a multi-layered shell to attenuate amplitude of mechanical waves of a blunt trauma to a human head by phase reversal of the mechanical waves at a boundary established between two adjacent layers of the multi-layered shell.

9 Claims, 5 Drawing Sheets

(56) References Cited

U.S. PATENT DOCUMENTS

| | | | | |
|---|---|---|---|---|
| 2003/0139104 | A1 | 7/2003 | Arai | |
| 2003/0140400 | A1 | 7/2003 | Ho | |
| 2003/0180517 | A1 | 9/2003 | Karall | |
| 2005/0196592 | A1 | 9/2005 | Tao et al. | |
| 2006/0137073 | A1 | 6/2006 | Crisco | |
| 2006/0248630 | A1 | 11/2006 | Bullock et al. | |
| 2008/0066217 | A1* | 3/2008 | Depreitere | A42B 3/064 2/412 |
| 2008/0120764 | A1 | 5/2008 | Sajic | |
| 2009/0266663 | A1 | 10/2009 | Lin | |
| 2010/0000009 | A1 | 1/2010 | Morgan | |
| 2010/0299812 | A1 | 12/2010 | Maddux et al. | |
| 2011/0047678 | A1 | 3/2011 | Barth et al. | |
| 2012/0060251 | A1 | 3/2012 | Schimpf | |
| 2012/0151664 | A1 | 6/2012 | Kirshon | |
| 2012/0198604 | A1 | 8/2012 | Weber et al. | |
| 2013/0061375 | A1 | 3/2013 | Bologna et al. | |
| 2013/0152287 | A1 | 6/2013 | Cormier et al. | |
| 2013/0185837 | A1 | 7/2013 | Phipps et al. | |
| 2014/0053323 | A1 | 2/2014 | Marzec et al. | |
| 2014/0196198 | A1* | 7/2014 | Cohen | A42B 3/063 2/414 |
| 2014/0208486 | A1 | 7/2014 | Krueger | |
| 2014/0373257 | A1* | 12/2014 | Turner | A42B 3/125 2/414 |
| 2015/0089721 | A1* | 4/2015 | Hanna | A42B 3/069 2/412 |
| 2015/0157083 | A1 | 6/2015 | Lowe | |
| 2015/0223546 | A1* | 8/2015 | Cohen | A42B 3/063 2/412 |
| 2015/0264991 | A1 | 9/2015 | Frey | |
| 2015/0305427 | A1 | 10/2015 | Prabhu et al. | |
| 2016/0021967 | A1* | 1/2016 | Finiel | A42B 3/283 2/411 |
| 2016/0242487 | A1* | 8/2016 | LaRocque | A42B 3/069 |
| 2016/0270471 | A1* | 9/2016 | Merrell | A42B 3/121 |
| 2017/0367431 | A1* | 12/2017 | Lee | A42B 3/122 |

* cited by examiner

MECHANICAL-WAVES ATTENUATING PROTECTIVE HEADGEAR

TECHNICAL FIELD

The present invention relates generally to the field of protecting a human brain upon a trauma. More specifically, the present invention provides an apparatus to reduce amplitude of mechanical waves from the trauma to the human brain.

BACKGROUND OF THE INVENTION

Boundary effect of mechanical waves of a blunt trauma can be exploited for reducing amplitude of the mechanical waves delivered to a brain tissue, using a multi-layered protective shell to increase number of boundaries inside the protective shell of a headgear as practically many as possible to a point there would not be a serious tissue injury to the brain tissue. Separately in a model of a two-layer medium panel with a first layer adjoining a second layer without a gap, it is known that there is no phase change at a boundary between the first layer and the second layer having a lower hardness than that of the first layer in reflected mechanical waves from incident mechanical waves traveling from the first layer to the second layer. Combination of both the incident and reflected mechanical waves in phase with each other temporarily increases an amplitude of the incident mechanical waves which increases an amplitude of transmitted mechanical waves in the second layer from the incident mechanical waves. If a series of the incident mechanical waves impacts the first layer, an amplitude of the reflected mechanical waves off the boundary merges with an amplitude of successive mechanical waves following a first wave of the mechanical waves coming toward the first layer. The amplitude of the successive mechanical waves following the first wave of the mechanical waves temporarily increases upon the addition of the amplitude of the reflected mechanical waves in phase with the successive mechanical waves, which increases a magnitude of an impact of the successive mechanical waves following the first wave of the mechanical waves to the second layer. If the first layer is made of a material that has a lower hardness than that of the second layer, the reflected mechanical waves off the boundary between the first and the second layers from the first wave reverse the phase and merge with the successive mechanical waves coming toward the first layer in a way the amplitude of the successive mechanical waves decreases. It results in a reduction of the magnitude of the impact of the successive mechanical waves to the second layer.

Collision between two objects is a bidirectional process involving a first object having a first kinetic energy colliding a second object having a second kinetic energy. If the first object is an inanimate object and the second object is a human head, the second object needs to reduce the kinetic energy of an impact from the first object, to transfer the kinetic energy of its own efficiently away from the second object and to lower a reflected portion of the kinetic energy of its own back to the second object in order to decrease an overall kinetic energy delivered to the second object. A method to increase the transfer of the kinetic energy of its own of the second object is to cover the second object with an A layer having a high transfer function which allows the kinetic energy from the second object to be transferred to a B layer having a lower transfer function than the A layer. The B layer is placed on an opposite side of the A layer to a side of the A layer contacting the second object. An opposite side of the B layer is placed in contact with the second layer of the two-layer medium panel. Separately, a method to reduce the reflected portion of the kinetic energy of the second object back to the second object is to use a softer material for the A layer than a bony material of the second object, and to use a softer material for the B layer than that of the A layer. In a direction toward the second object, a boundary between the B and A layers bounces off the mechanical waves residing in the B layer of both the reflected mechanical waves of the second object and a transmitted portion of the mechanical waves from the second layer of the two-layer medium panel heading toward the second object. Since the B layer is softer than the A layer, there is a phase reversal of the mechanical waves which are reflected back toward the second layer of the two-layer medium panel, thereby reducing an amplitude of the mechanical waves heading toward the second object. At a boundary between the A layer and the second object, there is another phase reversal of the mechanical waves heading toward the second object since the A layer is softer than the second object, further reducing the amplitude of the mechanical waves toward the second object.

The mechanical waves from the first object transmitted through the second layer to the B layer can be amplified or deamplified at a colliding boundary between the second layer and the B layer based on a phase of the mechanical waves inside the B layer generated from the second object. Since the phase of the mechanical waves inside the B layer generated from the second object may not be made in phase or out of phase with the phase of the mechanical waves from the first object and would not be controllable, it would be advantageous to deplete the kinetic energy of the mechanical waves inside the B layer from the second object before it reaches the second layer of the two-layer panel. It also applies to depletion of the mechanical waves from the first object coming out of the second layer heading toward the second object. One way of depletion of the kinetic energy of the mechanical waves inside the B layer is to make the B layer retain gas in a natural state and reversibly release the gas to ambient air upon collapsible compression of the B layer. Of materials transferring kinetic energy from the mechanical waves, air (gas) has by far a lowest density of molecules per area, thereby having a lowest index of transfer function as a medium for the mechanical waves. A fraction of the kinetic energy of the mechanical waves from the second object toward the first object will be released from the B layer before impacting the second layer of the two-layer medium panel and a fraction of of the kinetic energy of the mechanical waves from the first object toward the second object similarly will be released from the B layer before impacting the A layer. The depletion of the mechanical waves by releasing the gas can also be applied to the first layer of the two-layered medium panel and the A layer, except for the second layer of the two-layered medium panel. A main role of the second layer is to protect the second object against mechanical damage such as fracture of a human skull.

SUMMARY OF THE INVENTION

In one embodiment to improve on efficiency of a protective headgear in reduction of an amplitude of mechanical waves of a blunt trauma to a human brain, a basic motif of the present invention for the protective headgear comprises an at-least four-layer shell having a first and outermost layer being softer than a second layer which is hardest and made undeformable, an innermost layer being softer than a human skull, and a third layer in between the innermost layer and the undeformable second layer. The third layer in between the innermost layer and the second layer is softer than the innermost layer and the second layer. All three layers except the second layer are to an extent compressible and depressibly deformable by an impact of the blunt trauma at an angle to a planar surface of each layer. Each layer is configured to have a measurable thickness and to be placed next to adjacent layers tightly without a gap.

In one embodiment, the second layer is made of a combination of hard polymers such as polycarbonate, ethylene propylene diene, fluropolymers, or styrene-butadiene-styrene block copolymer. The hard polymers of the second layer are made to have a Rockwell R value of higher than 140 so as to withstand a blunt impact without deformation of a planar surface of the second layer over a gravitational force up to 300 g±30 g (10% S.D.) and over a range of temperature from 0° F. to 175° F. without material failure. The second layer is configured in a hemispherical bowl shape to enclose the third layer.

In one embodiment, the outermost and innermost layers are made of a polymer foam which is configured in a closed-cell structure to achieve a high ratio of indentation force deflection to density. Examples of the polymer foam include polyolefin foams, polyethylene foams, and flexible polyurethane foams. Ideally the polymer foam for both the outermost and innermost layers has a 25% indentation force deflection value of higher than 45 and a foam support factor of higher than 3.0. The outermost layer is configured to have a Rockwell R value ranging from 70 to 140. The innermost layer is configured to have a hardness of a Shore D scale value of between 65 and 90, as a Shore D scale value of bone is known to be just below 100. The outermost layer in the hemispherical bowel shape adherently encloses the second layer. The innermost layer in a similar hemispherical bowel shape is configured to enclosably cover an area of the human head comprising a part of frontal, an entire parietal, a majority of temporal and occipital regions.

In one embodiment, the third layer is made of a polymer foam in a flexible open-cell configuration so as to release a portion of transmitted mechanical waves to an ambient air. Examples of the polymer foam include open-cell polyester-urethane foams, open-cell polyurethane foams, open-cell polyolefin foams, and open-cell polyethylene foams. The polymer foam for the third layer has a 25% indentation force deflection value of higher than 45 and a foam support factor of between 1.5 and 3.0. The third layer is configured to have a hardness of a Shore D scale value of at least 10 below the Shore D scale value of the innermost layer. The third layer is configured in a similar hemispherical bowel shape to that of the second layer and is configured to be tightly encased in a hemispherical space provided by the second layer and the innermost layer. A circumferential rim of the third layer and an encircling margin of a plurality of fenestrations of the third layer is configured to be fixedly adhered to a corresponding rim and a corresponding encircling margin of a plurality of fenestrations of the second layer and of the innermost layer, respectively, leaving the rest of surface of the third layer unattached so as to assist movement of air in and out of open cells of the third layer.

DETAILED DESCRIPTION OF THE DRAWINGS

As described below, the present invention provides a mechanical-waves attenuating protective headgear. It is to be understood that the descriptions are solely for the purposes of illustrating the present invention, and should not be understood in any way as restrictive or limited. Embodiments of the present invention are preferably depicted with reference to FIGS. 1 to 5, however, such reference is not intended to limit the present invention in any manner. The drawings do not represent actual dimension of devices, but illustrate the principles of the present invention.

Figure 1:
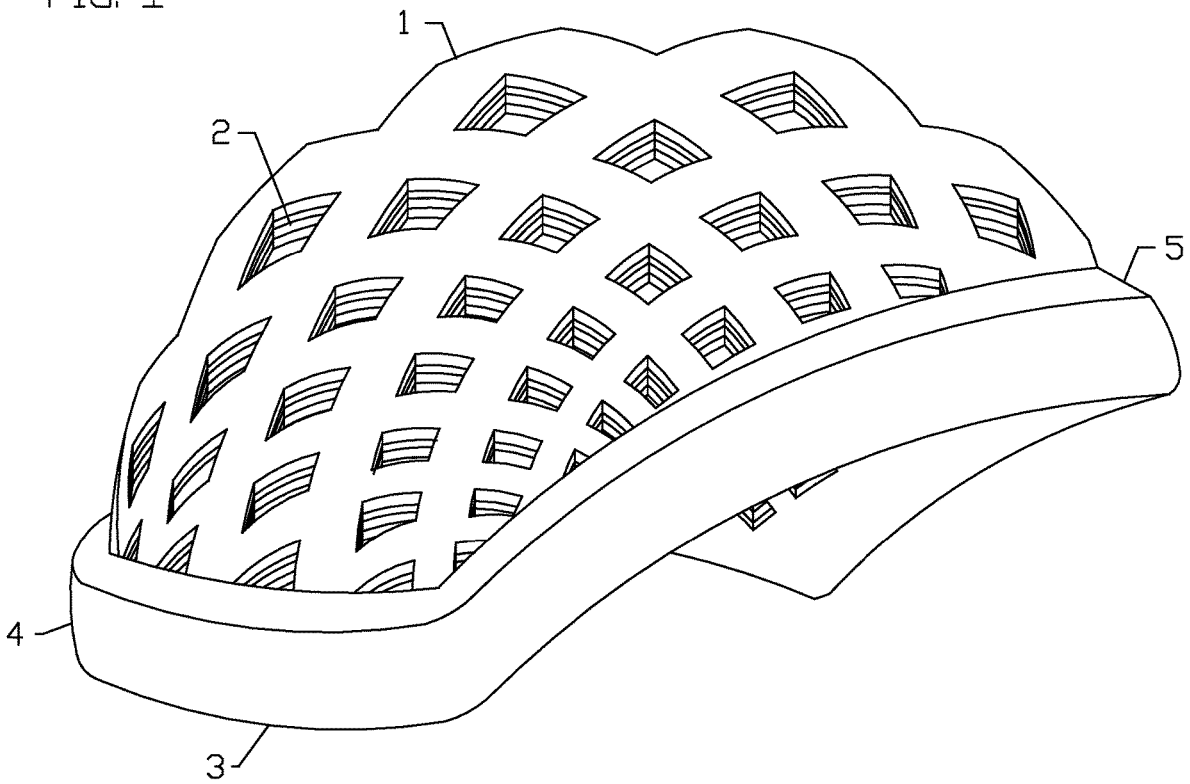
FIG. 1 shows a schematic presentation of a mechanical-waves attenuating protective headgear.

FIG. 1 shows a schematic presentation of a mechanical-waves attenuating protective headgear which comprises a dome portion 1 covering the majority of a head including frontal, parietal, sphenoid, occipital and temporal regions, a plurality of fenestrations 2 for ventilation of said mechanical-waves attenuating protective headgear, a lower rim 3 covering a portion of zygomatic arch and mastoid protuberance, an occipital portion 4 of the lower rim covering the occipital region to below external occipital protuberance and a frontal portion 5 of the lower rim covering down to a part of a vertical portion of the frontal region of the head.

Figure 2A:
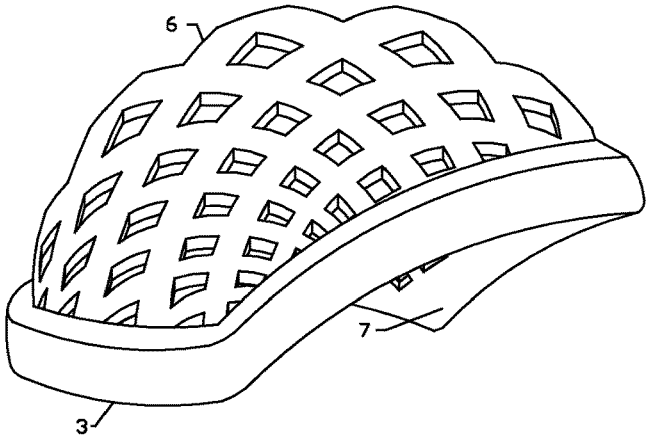
FIG. 2A represents a schematic view of an outermost layer.

FIGS. 2A -2D show a schematic view of individual layers of the mechanical-waves attenuating protective headgear. FIG. 2A represents a schematic view of a hemispherically-bowel-shaped outermost layer which is configured to adhere fixedly to a hemispherically-bowel-shaped second layer of FIG. 2B. The outermost layer in FIG. 2A comprises an outer surface 6, an inner surface 7 configured to adhere tightly to an upper surface 8 of the second layer of FIG. 2B, and the lower rim 3 which is configured to adherently fasten the outermost layer to an outer circumferential rim 9 of the second layer of FIG. 2B. The outermost layer comprises a closed-cell polymer foam having a measurable thickness ranging from 0.2 inches to 2.0 inches, which is configured to be compressible and depressibly deformable by an impact of a blunt trauma at an angle to a planar surface of the outermost layer. The closed-cell polymer foam of the outermost layer has a 25% indentation force deflection value of higher than 45, a foam support factor of higher than 3.0, and a Rockwell R value ranging from 70 to 140.

Figure 2B:
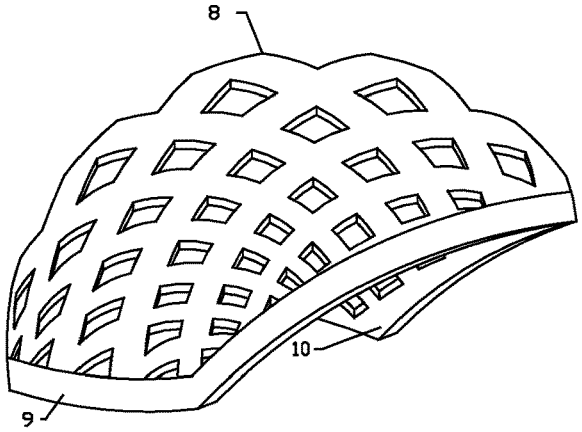
FIG. 2B shows a schematic view of a second layer.

FIG. 2B shows a schematic view of the hemispherically-bowel-shaped second layer which comprises the outer surface 8, an inner surface 10, and the outer circumferential rim 9. The inner surface 10 is configured to enclosably cover an outer surface 11 of a third layer of FIG. 2C. A portion of the inner surface 10 corresponding to the outer circumferential rim 9 adheres fixedly to an outer circumferential rim 12 of a hemispherically-bowel-shaped third layer of FIG. 2C. The second layer comprises a hemispherically-bowel-shaped solid plate having a measurable thickness ranging from 0.1 inches to 1.0 inches, which is made of hard polymers having a Rockwell R value of higher than 140 and configured to be undeformable to the impact of the blunt trauma at an angle to a planar surface of the second layer over a gravitational force of up to 300 g±30 g (10% S.D.) and over a range of temperature from 0° F. to 175° F. without material failure.

Figure 2C:
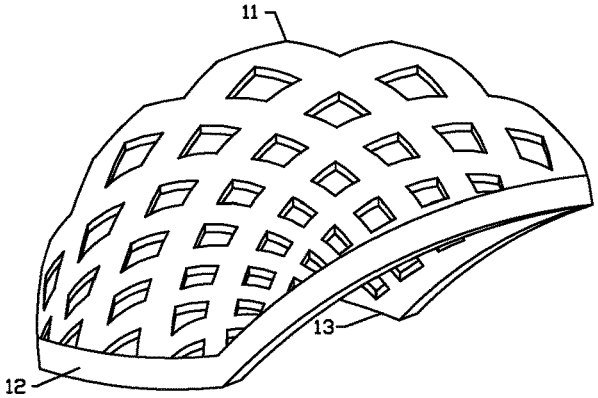
FIG. 2C shows a schematic view of a third layer.

FIG. 2C shows a schematic view of the hemispherically-bowel-shaped third layer which comprises the outer surface 11, an inner surface 13, and the outer circumferential rim 12. The inner surface 13 is configured to enclosahly cover an outer surface 14 of a hemispherically-bowel-shaped innermost layer of FIG. 2D. A portion of the inner surface 13 corresponding to the outer circumferential rim 12 adheres fixedly to an outer circumferential rim 15 of the innermost layer of FIG. 2D. The third layer comprises an open-cell polymer foam having a measurable thickness ranging from 0.2 inches to 2.0 inches, which is configured to be compressible and depressibly deformable by the impact of the blunt trauma at an angle to a planar surface of the third layer. The open-cell polymer foam of the third layer has a 25% indentation force deflection value of higher than 45, a foam support factor of between 1.5 and 3.0, and a hardness of a Shore D scale value of at least 10 below the Shore D scale value of the innermost layer of FIG. 2D.

Figure 2D:
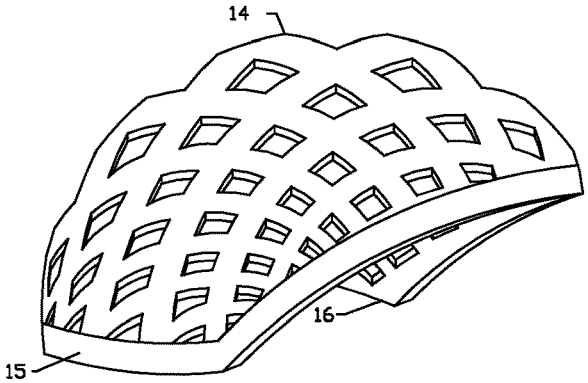
FIG. 2D shows a schematic view of an innermost layer.

FIG. 2D shows a schematic view of the hemispherically-bowel-shaped innermost layer which comprises the outer surface 14, an inner surface 16, and the outer circumferential rim 15. The innermost layer comprises a closed-cell polymer foam having a measurable thickness ranging from 0.2 inches to 2.0 inches, which is configured to be compressible and depressibly deformable by the impact of the blunt trauma at an angle to a planar surface of the innermost layer. The closed-cell polymer foam of the innermost layer has a 25% indentation force deflection value of higher than 45, a foam support factor of higher than 3.0, and a hardness of a Shore D scale value of between 65 and 90. The inner surface 16 is configured to enclosably cover an area of the human head comprising a part of the frontal, the entire parietal, a majority of the temporal region and a majority of the occipital region.

Figure 3:
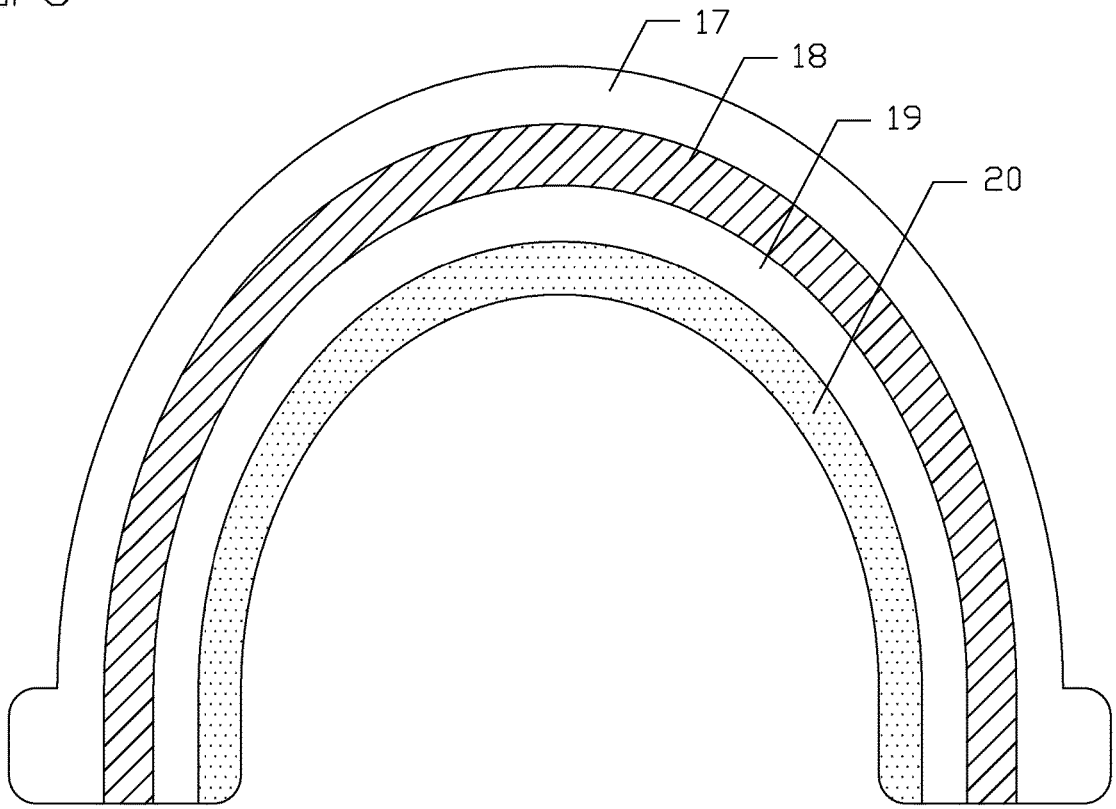
FIGS. 3 illustrates a schematic coronal view of a stacked-up four-layer mechanical-waves attenuating protective headgear.

FIG. 3 illustrates a schematic coronal view of a stacked-up four-layer mechanical-waves attenuating protective headgear. The outermost layer is represented as 17; the second layer as 18; the third layer as 19; the innermost layer as 20. The outermost layer 17 adheres tightly to the second layer 18 so as to facilitate reflection of incident mechanical waves off a boundary between the inner surface of the outermost layer and the outer surface of the second layer, shown in FIGS. 2A and 2B. The inner surface of the second layer 18 shown in FIG. 2B is tightly placed in contact with the outer surface of the third layer 19 shown in FIG. 2C. There is no adhesion between the inner surface of the second layer 18 and the outer surface of the third layer 19, which is to facilitate air movement in and out of open cells of the open-cell polymer foam of the third layer 19. The inner surface of the third layer 19 shown in FIG. 2C is tightly placed in contact with the outer surface of the innermost layer 20 shown in FIG. 2D. There is no adhesion between the inner surface of the third layer 19 and the outer surface of the innermost layer 20. All four layers are made adhere to the circumferential rim of each layer shown FIGS. 2A-2D. In addition all four layers are made to adhere to each layer at an encircling margin of a plurality of the fenestrations shown in FIG. 1 as 2.

Figure 4:
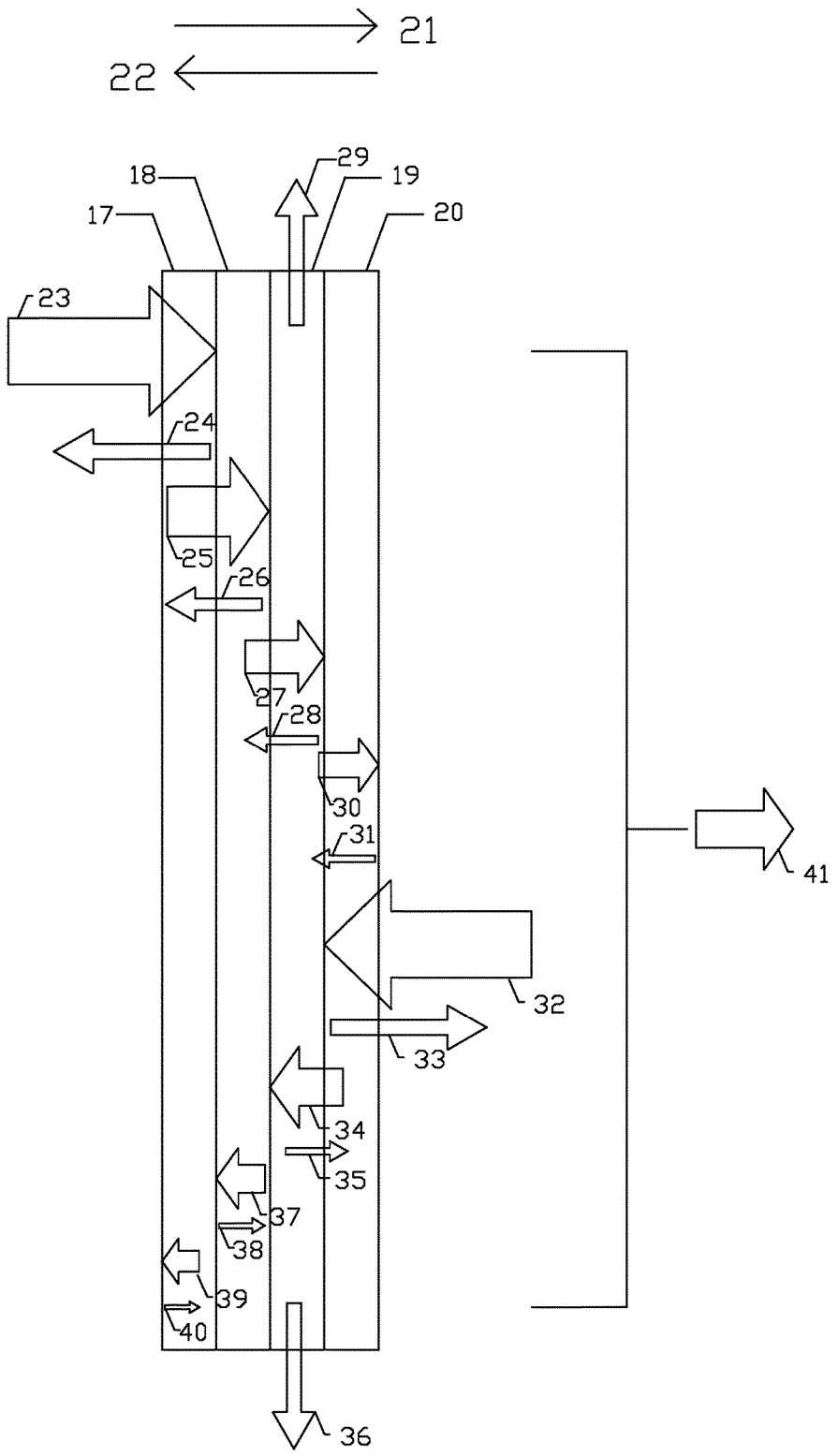
FIG. 4 depicts a schematic view of sequential changes in mechanical waves across boundaries of each layer of the four-layer mechanical-waves attenuating protective headgear upon a collision.

FIG. 4 depicts a schematic view of sequential changes of mechanical waves across boundaries of each layer of the four-layer mechanical-waves attenuating protective headgear upon a collision. In a direction of 21 toward a human head (not shown) wearing the four-layer mechanical-waves attenuating protective headgear, incidental mechanical waves 23 from a colliding object (not shown) come to a boundary established between the outermost layer 17 and the second layer 18. A part of the mechanical waves 23 are reflected off at the boundary to become reflected mechanical waves 24 and a remaining part of the mechanical waves is transmitted as 25 toward a boundary established between the second layer 18 and the third layer 19. At the boundary between the second layer 18 and the third layer 19, a part of the transmitted mechanical waves 25 is reflected off as reflected mechanical waves 26, heading back to the second layer 18 in an opposite direction 22 and a remaining part of the transmitted mechanical waves 25 becomes mechanical waves 27 heading toward a boundary established between the third layer 19 and the innermost layer 20. Inside the third layer which is the open-cell polymer foam, a part of the mechanical waves 27 is released as mechanical waves 29 coincided with collapsing compression of the third layer thereby pushing a trapped air in open air cells of the open-cell polymer foam of the third layer out to ambient air. A part of the mechanical waves 27 is reflected off at the boundary between the third layer 19 and the innermost layer 20 as reflected mechanical waves 28. A remaining part of the mechanical waves 27 becomes mechanical waves 30 heading toward a boundary between the innermost layer 20 and the human head (not shown). Similar to other boundaries, at the boundary between the innermost layer 20 and the human head, a part of the transmitted mechanical waves 30 is reflected off at the boundary as reflected mechanical waves 31 and a remaining part of the mechanical waves is transmitted to the human head.

Since the collision is a bidirectional process, the human head (not shown) collides the innermost layer 20 in an opposite direction 22 toward the colliding object (not shown) at a time of the collision with the colliding object, thereby generating its' own incident mechanical waves 32 heading toward the outermost layer 17. At the boundary between the innermost layer 20 and the third layer 19, a part of the incident mechanical waves 32 is reflected off as reflected mechanical waves 33 and a part of the mechanical waves 32 is transmitted as transmitted mechanical waves 34 heading toward the boundary between the third layer 19 and the second layer 18. In the third layer 19, a part of the mechanical waves 34 is released from the third layer as mechanical waves 36 to the ambient air, which is coincided with the collapsing compression of the third layer 19. Another part of the mechanical waves 34 is reflected off at the boundary between the third layer 19 and the second layer 18 heading back in the direction of 21. A remaining part of the mechanical waves 34 is transmitted through the second layer 18 as transmitted mechanical waves 37 moving toward the boundary between the second layer 18 and the outermost layer 17. At the boundary between the second layer 18 and the outermost layer 17, the transmitted mechanical waves 37 is reflected off as reflected mechanical waves 38. A remaining part of the mechanical waves 37 is transmitted to an outer surface of the outermost layer 17 as transmitted mechanical waves 39. A part of the mechanical waves 39 is reflected off at the outer surface of the outermost layer 17 as reflected mechanical waves 40. A sum of these incident, reflected and transmitted mechanical waves is represented as final incident mechanical waves 41 in the direction of 21 to the human head receiving the impact of the blunt trauma of the collision.

Figure 5:
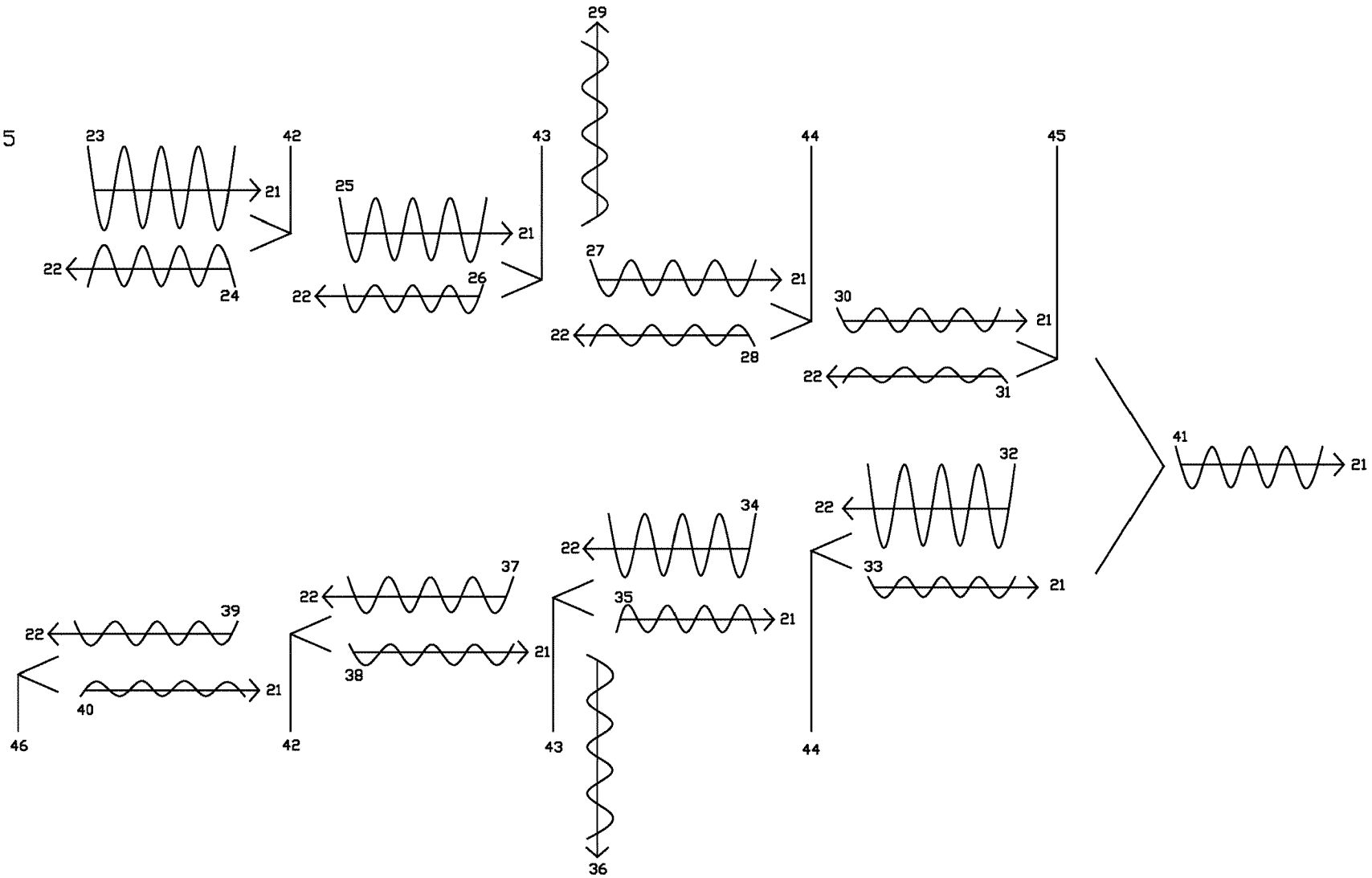
FIG. 5 illustrates a schematic view of sequential changes in amplitudes and phases of the mechanical waves across the boundaries of each layer of the four-layer mechanical-waves attenuating protective headgear upon the collision.

FIG. 5 illustrates a schematic view of sequential changes in amplitudes and phases of the mechanical waves across the boundaries of each layer, based on a hardness of the layer, of the four-layer mechanical-waves attenuating protective headgear upon the collision shown in FIG. 4. The incident mechanical waves 23 comes to a boundary 42 between the outermost layer and the second layer in the direction of 21 toward the human head (not shown). Since the hardness of the outermost layer is lower than that of the second layer, the reflected mechanical waves 24 are reflected in a reverse phase to a phase of the incident mechanical waves 23. Merging of two mechanical waves 23 and 24 together results in a reduced amplitude of the transmitted mechanical waves 25 which moves toward the boundary 43 between the second layer and the third layer. Since the hardness of the second layer is higher than that of the third layer, the reflected mechanical waves 26 are in phase with the mechanical waves 25. Temporary summation of both the mechanical waves 25 and 26 occurs, resulting in an increased amplitude of the transmitted mechanical waves 27 heading toward the boundary 44 between the third layer and the innermost layer. To reduce the increased amplitude of the mechanical waves 27, the third layer comprises the open-cell polymer foam which is configured to release a part of the mechanical waves out to the ambient air as the mechanical waves 29. The hardness of the third layer is lower than that of the innermost layer, so as to reverse the phase of the reflected mechanical waves 28. Merging of two mechanical waves 27 and 28 together results in a reduced amplitude of the transmitted mechanical waves 30 which heads toward the boundary 45 between an inner surface of the innermost layer and an outer surface of the human head (not shown). The hardness of the innermost layer is lower than that of skull bone of the human head, which reverses the reflected mechanical waves 31. Merging of two mechanical waves 30 and 31 together results in a reduced amplitude of mechanical waves which contribute to the final incident mechanical waves 41 delivered to the human head in the direction of 21.

Similarly, the incident mechanical waves 32 from the human head (not shown) move toward the colliding object (not shown) and are reflected off at the boundary 44 between the innermost layer and the third layer. Since the hardness of the third layer is lower than that of the innermost layer, the reflected mechanical waves 33 is in phase with the mechanical waves 32, which results in a higher amplitude of the transmitted mechanical waves 34 through the third layer. The reflected mechanical waves 35 at the boundary 43 between the third layer and the second layer merges with the mechanical waves 34 in a reverse phase. Additionally, a part of the mechanical waves 34 is released to the ambient air as the mechanical waves 36, thereby reducing a part of the amplitude of the transmitted mechanical waves 37 to the second layer. The transmitted mechanical waves 37 are reflected off as the mechanical waves 38 in phase with the transmitted mechanical waves 37, which increases am amplitude of the transmitted mechanical waves 39 to the outermost layer. At an outer surface 46 of the outermost layer, the transmitted mechanical waves 39 are reflected off as the reflected mechanical waves 40 in a reverse phase as a hardness of the colliding object is higher than that of the outermost layer. Merging of two mechanical waves 39 and 40 together reduces an amplitude of transmitted mechanical waves (not shown) in the direction of 22 to the colliding object (not shown).

It is to be understood that the aforementioned description of the apparatus is simple illustrative embodiments of the principles of the present invention. Various modifications and variations of the description of the present invention are expected to occur to those skilled in the art without departing from the spirit and scope of the present invention. Therefore the present invention is to be defined not by the aforementioned description but instead by the spirit and scope of the following claims.

What is claimed is:

1. A mechanical-waves attenuating protective headgear, comprising a four-layer shell having an outermost layer of a closed-cell polymer foam, a second layer of a solid polymer plate, a third layer of an open-cell polymer foam, and an innermost layer of a closed-cell polymer foam, wherein the four-layer shell comprises:

the outermost layer is fenestrated with a plurality of fenestrations so as to form a fenestrated outermost layer, and wherein the fenestrated outermost layer is configured to have a hardness value of a Rockwell R value ranging from 70 to 140;

the second layer is fenestrated with a plurality of fenestrations so as to form a fenestrated second layer, wherein each fenestration of the plurality of the fenestration of the fenestrated second layer is coaxially aligned with each corresponding fenestration of the plurality of the fenestration of the fenestrated outermost layer, and wherein the fenestrated second layer is configured to have the hardness value of a Rockwell R value of higheer than 140;

the third layer is fenestrated with a plurality of fenestrations so as to form a fenestrated third layer, wherein each fenestration of the plurality of the fenestration of the fenestrated third layer is coaxially aligned with each correspoinding fenestration of the plurality of the fenestration of the fenestrated second layer, and wherein the fenestrated third layer is configured to have the hardness value of a Shore D scale value of at least 10 below a Shore D scale value of the innermost layer; and the innermost layer is fenestrated with a plurality of fenestrations so as to form a fenestrated innermost layer, wherein each fenestration of the plurality of the fenestration of the fenestrated innermost layer is coaxially aligned with each corresponding fenestration of the plurality of the fenestration of the fenestrated third layer, and wherein the fenestrated innermost layer is configured to have a lower hardness value of the Shore D scale value of between 65 and 90 than a Shore D scale value of less than 100 adaptively of a human skull bone.

2. The mechanical-waves attenuating protective headgear according to claim 1, wherein the closed-cell polymer foam of the fenestrated outermost layer is configured to have a 25% indentation force deflection value of higher than 45, and a foam support factor of higher than 3.0.

3. The mechanical-waves attenuating protective headgear according to claim 1, wherein the fenestrated second layer enclosably covers the fenestrated third layer, and wherein the solid polymer plate of the fenestrated second layer having the hardness value of the Rockwell R value of higher than 140 is configured to be undeformable to the impact of a blunt trauma at an angle to a planar surface of said fenestrated second layer over a gravitational force of up to 300 g±30 g (10% S.D.) and over a range of temperature from 0° F. to 175° F.

4. The mechanical-waves attenuating protective headgear according to claim 1, wherein the fenestrated third layer is configured to be tightly encased in a hemispherical space provided by the fenestrated second layer and the fenestrated innermost layer, wherein the open-cell polymer foam of the fenestrated third layer is configured to have a 25% identation force deflection value of higher than 45, and a foam support factor of between 1.5 and 3.0.

5. The mechanical-waves attenuating protective headgear according to claim 1, wherein the closed-cell polymer foam of the fenestrated innermost layer is configured to have a 25% indentation force deflection value of higher than 45, and a foam support factor of higher than 3.0.

6. The mechanical-waves attenuating protective headgear according to claim 1, wherein circumferential rims of the fenestrated second, third and innermost layers are fixedly adhered to each other for each individual layer, and wherein encircling margins of the plurality of fenestrations of the fenestrated second, third and innermost layers are fixedly adhered to each other for each fenestration.

7. The mechanical-waves attenuating protective headgear according to claim 1, wherein an inner surface of the fenestrated outermost layer having the Rockwell R value ranging from 70 to 140 adheres tightly to an outer surface of the fenestrated second layer having the Rockwell R value of higher than 140, wherein the inner surface of the fenestrated outermost layer tightly adhered to the outer surface of the fenestrated second layer forms a boundary between the fenestrated outermost layer and the fenestrated second layer, and wherein the boundary between the fenestrated outermost layer and the fenestrated second layer is configured to reduce amplitudes of transmitted mechanical waves of the blunt trauma on said mechanical-waves attenuating protective headgear across the boundary between the fenestrated outermost layer and the fenestrated second layer.

8. The mechanical-waves attenuating protective headgear according to claim 1, wherein an inner surface of the fenestrated third layer having the Shore D scale value of at least 10 below the Shore D scale value of the fenestrated innermost layer tightly placed in contact with an outer surface of the fenestrated innermost layer having the the Shore D scale value of between 65 and 90, wherein the inner surface of the fenestrated third layer tightly placed in contact with the outer surface of the fenestrated innermost layer forms a boundary between the fenestrated third layer and the fenestrated innermost layer, and wherein the boundary between the fenestrated third layer and the fenestrated innermost layer is configured to reduce the amplitudes of transmitted mechanical waves of the blunt trauma on said mechanical-waves attenuating protective headgear across said boundary between the fenestrated third layer and the fenestrated innermost layer.

9. The mechanical-waves attenuating protective headgear according to claim 1, wherein the fenestrated third layer of the open-cell polymer foam is tightly encased in the hemispherical space provided by the fenestrated second layer of the solid polymer plate and the fenestrated innermost layer of the closed-cell polymer foam, wherein the fenestrated third layer of the open-cell polymer foam is configured to release a part of mechanical waves of the blunt trauma transmitted across the fenestrated third layer adaptively to ambient air.

* * * * *